US009076585B2

(12) United States Patent
Yang et al.

(10) Patent No.: US 9,076,585 B2
(45) Date of Patent: Jul. 7, 2015

(54) ELECTRONIC COMPONENT AND METHOD FOR MANUFACTURING THE SAME

(71) Applicant: SAMSUNG ELECTRO-MECHANICS CO., LTD., Suwon (KR)

(72) Inventors: Ju Hwan Yang, Suwon (KR); Sang Moon Lee, Suwon (KR); Young Seuck Yoo, Suwon (KR); Sung Kwon Wi, Suwon (KR)

(73) Assignee: SAMSUNG ELECTRO-MECHANICS CO., LTD., Suwon (KR)

( * ) Notice: Subject to any disclaimer, the term of this patent is extended or adjusted under 35 U.S.C. 154(b) by 26 days.

(21) Appl. No.: 13/800,135

(22) Filed: Mar. 13, 2013

(65) Prior Publication Data

US 2013/0265131 A1 Oct. 10, 2013

(30) Foreign Application Priority Data

Apr. 5, 2012 (KR) ..... 10-2012-0035514

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 41/10*** | (2006.01) |
| ***H01F 17/00*** | (2006.01) |

(52) U.S. Cl.

CPC ..... *H01F 27/29* (2013.01); *H01F 41/10* (2013.01); *Y10T 29/4902* (2015.01); *H01F 17/0013* (2013.01); *H01F 2017/0093* (2013.01)

(58) Field of Classification Search

CPC ..... H01F 5/00; H01F 27/28
USPC ..... 336/200, 232
See application file for complete search history.

(56) References Cited

U.S. PATENT DOCUMENTS

2010/0157501 A1* 6/2010 Asakura et al. ..... 361/112
2011/0007439 A1* 1/2011 Asakawa et al. ..... 361/56

FOREIGN PATENT DOCUMENTS

KR 10-2011-0082641 7/2011
WO WO 2008127023 A1 * 10/2008

* cited by examiner

*Primary Examiner* — Tsz Chan

(57) ABSTRACT

The present invention relates to an electronic component having a primary coil pattern and a secondary coil pattern with at least one selected from a dielectric and an insulator interposed therebetween, which includes at least one discharge terminal for discharging overvoltage or overcurrent applied to the primary coil pattern or the secondary coil pattern, and a method for manufacturing the same. Since it is possible to efficiently discharge overvoltage or overcurrent applied to an electronic component, it is possible to improve reliability of various electronic devices to which the electronic component in accordance with an embodiment of the present invention is applied as well as to extend lifespan of the electronic component itself.

7 Claims, 7 Drawing Sheets

ELECTRONIC COMPONENT AND METHOD FOR MANUFACTURING THE SAME

CROSS-REFERENCE TO RELATED APPLICATIONS

This application claims the benefit under 35 U.S.C. Section 119 of Korean Patent Application Ser. No. 10-2012-0035514, filed Apr. 5, 2012, which is hereby incorporated by reference in its entirety into this application.

BACKGROUND OF THE INVENTION

1. Field of the Invention

The present invention relates to an electronic component and a method for manufacturing the same, and more particularly, to an electronic component having a means that can discharge overvoltage or overcurrent when the overvoltage or the overcurrent is applied to the electronic component due to static electricity and so on, and a method for manufacturing the same.

2. Description of the Related Art

A common mode filter (CMF) is an electronic component that has been widely used to remove common mode noise in various electronic devices.

Recently, in line with miniaturization, thinning, and high functions of electronic products, studies on the CMF, which can be miniaturized and thinned while being improved in noise removal performance, have been continuously made.

At this time, various studies and attempts have been made to improve characteristics of the CMF such as inductance and DC resistance. As an example, there is a CMF disclosed in Patent Document 1, which has an increased cutoff frequency and improved impedance characteristics.

Meanwhile, overvoltage or overcurrent, which is out of an acceptable range due to instability of input power or static electricity, is frequently applied to the various electronic devices to which this electronic component is applied.

In a conventional typical electronic component, an antistatic means is provided outside the electronic component to prevent problems such as deterioration of the electronic component or product failure when this overvoltage or overcurrent is applied. When a separate antistatic means is provided outside the electronic component like this, there were limits to miniaturization of the electronic devices.

RELATED ART DOCUMENT

Patent Document

Patent Document 1: Korean Patent Laid-open Publication No. 10-2011-0082641

SUMMARY OF THE INVENTION

The present invention has been invented in order to overcome the above-described problems and it is, therefore, an object of the present invention to provide an electronic component capable of overcoming problems due to overvoltage or overcurrent by disposing an antistatic means including a discharge terminal inside the electronic component, and a method for manufacturing the same.

Further, it is another object of the present invention to provide an electronic component capable of minimizing an increase in thickness or size while including an antistatic means inside the electronic component, and a method for manufacturing the same.

In accordance with one aspect of the present invention to achieve the object, there is provided an electronic component having a primary coil pattern and a secondary coil pattern with at least one selected from a dielectric and an insulator interposed therebetween, including: at least one discharge terminal for discharging overvoltage or overcurrent applied to the primary coil pattern or the secondary coil pattern.

At this time, a first primary external electrode is electrically connected to one end of the primary coil pattern, a second primary external electrode is electrically connected to the other end of the primary coil pattern, a first secondary external electrode is electrically connected to one end of the secondary coil pattern, a second secondary external electrode is electrically connected to the other end of the secondary coil pattern, and a discharge electrode is electrically connected to the discharge terminal, wherein the electronic component may further include a discharge pattern which is electrically connected to at least one selected from the first primary external electrode, the second primary external electrode, the first secondary external electrode, and the second secondary external electrode and disposed to be spaced apart from the discharge terminal by a predetermined gap.

Further, it is preferred that the gap is determined in the range of 1 to 10 μm.

Meanwhile, in accordance with another aspect of the present invention to achieve the object, there is provided an electronic component including: a first pattern layer, a second pattern layer, and an external electrode layer, wherein the first pattern layer includes: a first coil pattern portion including a first primary coil pattern, a first secondary coil pattern, a first primary pad electrically connected to one end of the first primary coil pattern, a first secondary pad electrically connected to one end of the first secondary coil pattern, a first primary internal terminal electrically connected to the other end of the first primary coil pattern, and a first secondary internal terminal electrically connected to the other end of the first secondary coil pattern; and a first discharge pattern portion including a first primary sub pad disposed adjacent to the first primary pad, a first discharge pattern of which one end is electrically connected to the first primary sub pad, and a first discharge terminal disposed to be spaced apart from the first discharge pattern by a predetermined gap, the second pattern layer includes: a second coil pattern portion including a second primary coil pattern, a second secondary coil pattern, a second primary pad electrically connected to one end of the second primary coil pattern, a second secondary pad electrically connected to one end of the second secondary coil pattern, a second primary internal terminal electrically connected to the other end of the second primary coil pattern, a second secondary internal terminal electrically connected to the other end of the second secondary coil pattern, and a second primary dummy pad electrically connected to the first primary pad; and a second discharge pattern portion including a first additional discharge terminal electrically connected to the first discharge terminal and a second primary dummy sub pad adjacent to the second primary dummy pad and electrically connected to the first primary sub pad, and the external electrode layer includes: a coil electrode portion including a first primary external electrode electrically connected to one end of a primary coil pattern formed by connecting the first primary coil pattern and the second primary coil pattern, a second primary external electrode electrically connected to the other end of the primary coil pattern, a first secondary external electrode electrically connected to one end of a secondary coil pattern formed by connecting the first secondary coil pattern and the second secondary coil pattern, and a second secondary external electrode electrically connected to the other end of the secondary coil pattern; and a discharge electrode portion including a first discharge electrode electrically connected to the first additional discharge terminal, wherein the second primary dummy sub pad may be electrically connected to the first primary external electrode.

At this time, the first coil pattern portion may further include a first primary dummy pad electrically connected to the second primary pad, the first discharge pattern portion may further include a first primary dummy sub pad adjacent to the first primary dummy pad and electrically connected to the second primary external electrode, a first dummy discharge pattern electrically connected to the first primary dummy sub pad, and a second discharge terminal disposed to be spaced apart from the first dummy discharge pattern by a predetermined gap, and the second discharge pattern portion may further include a second primary pad electrically connected to one end of the second primary coil pattern, a second primary sub pad adjacent to the second primary pad and electrically connected to the first primary dummy sub pad, and a second additional discharge terminal electrically connected to the second discharge terminal, wherein the second primary sub pad may be electrically connected to the second primary external electrode and the external electrode layer may further include a second discharge electrode electrically connected to the second additional discharge terminal.

Further, the first coil pattern portion may further include a first primary dummy pad electrically connected to the second primary pad, the first discharge pattern portion may further include a first primary dummy sub pad adjacent to the first primary dummy pad and electrically connected to the second primary external electrode and a second discharge terminal, and the second discharge pattern portion may further include a second primary pad electrically connected to one end of the second primary coil pattern, a second primary sub pad adjacent to the second primary sub pad and electrically connected to the first primary dummy sub pad, a first dummy discharge pattern electrically connected to the second primary sub pad, and a second additional discharge terminal spaced apart from the first dummy discharge pattern by a predetermined gap and electrically connected to the second discharge terminal, wherein the second primary sub pad may be electrically connected to the second primary external electrode, and the external electrode layer may further include a second discharge electrode electrically connected to the second additional discharge terminal.

Meanwhile, in accordance with another aspect of the present invention to achieve the object, there is provided an electronic component including: a discharge means at one or both sides of a secondary coil pattern.

In accordance with another aspect of the present invention to achieve the object, there is provided a method for manufacturing an electronic component, which includes a primary coil pattern and a secondary coil pattern with at least one selected from a dielectric and an insulator interposed therebetween and at least one discharge terminal for discharging overvoltage or overcurrent applied to the primary coil pattern and the secondary coil pattern, by a photoresist method, wherein a photoresist pattern, which exposes regions where the primary coil pattern and the secondary coil pattern are to be plated, may also expose a region where the discharge terminal is to be formed.

At this time, it is preferred that a discharge pattern, whose one end is connected to at least one of four external electrodes electrically connected to both ends of the primary coil pattern and the secondary coil pattern and the other end is spaced apart from the discharge terminal by a predetermined gap, is further formed.

Further, it is preferred that the gap is determined in the range of 1 to 10 μm.

Meanwhile, in accordance with another aspect of the present invention to achieve the object, there is provided a method for manufacturing an electronic component in accordance with claim 4 by a photoresist method, which includes: forming a first pattern layer by using a first photoresist pattern which exposes regions where a first coil pattern portion and a first discharge pattern portion are to be formed; forming a first insulating layer by applying an insulator or a dielectric on a top surface of the first pattern layer; forming a second pattern layer on a top surface of the first insulating layer by using a second photoresist pattern which exposes regions where a second coil pattern portion and a second discharge pattern portion are to be formed; and forming an external electrode layer on a top surface of the second pattern layer by using a third photoresist pattern which exposes regions where a coil electrode portion and a discharge electrode portion are to be formed.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERABLE EMBODIMENTS

Figure 1:
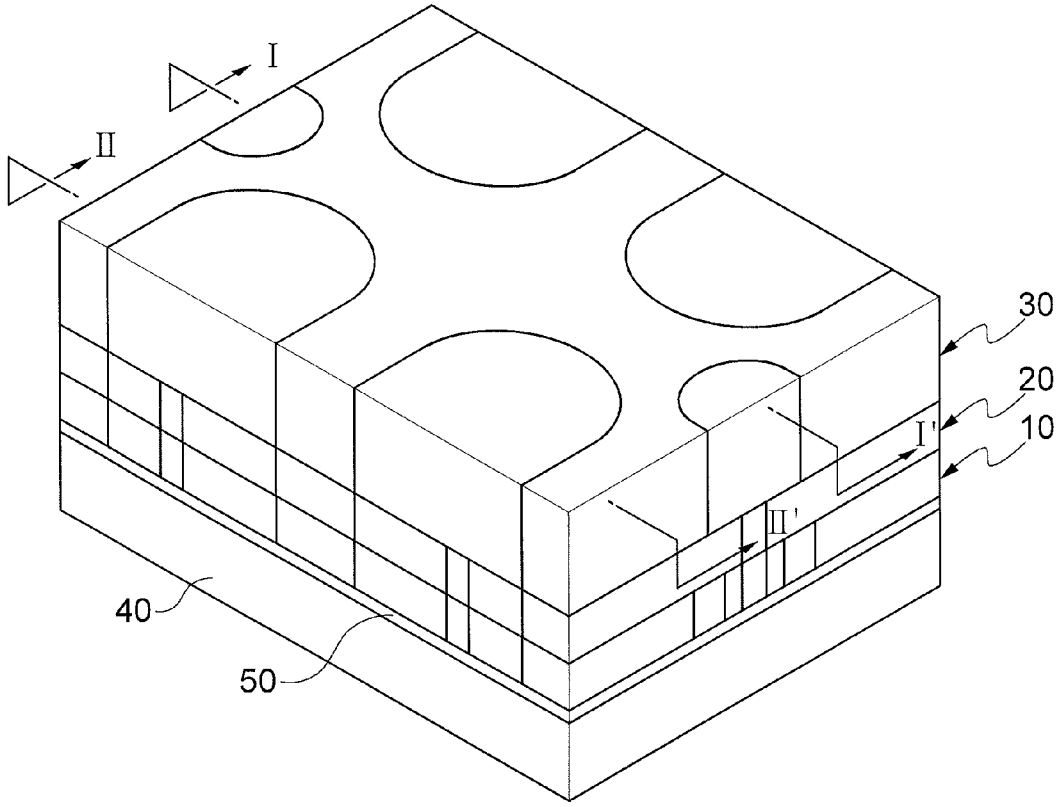
FIG. 1 is a perspective view schematically showing an electronic component in accordance with an embodiment of the present invention.

Advantages and features of the present invention and methods of accomplishing the same will be apparent by referring to embodiments described below in detail in connection with the accompanying drawings. However, the present invention is not limited to the embodiments disclosed below and may be implemented in various different forms. The embodiments are provided only for completing the disclosure of the present invention and for fully representing the scope of the present invention to those skilled in the art. Like reference numerals refer to like elements throughout the specification.

Terms used herein are provided to explain embodiments, not limiting the present invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Hereinafter, configurations and operational effects of the present invention will be described in detail with reference to the accompanying drawings.

Figure 2:
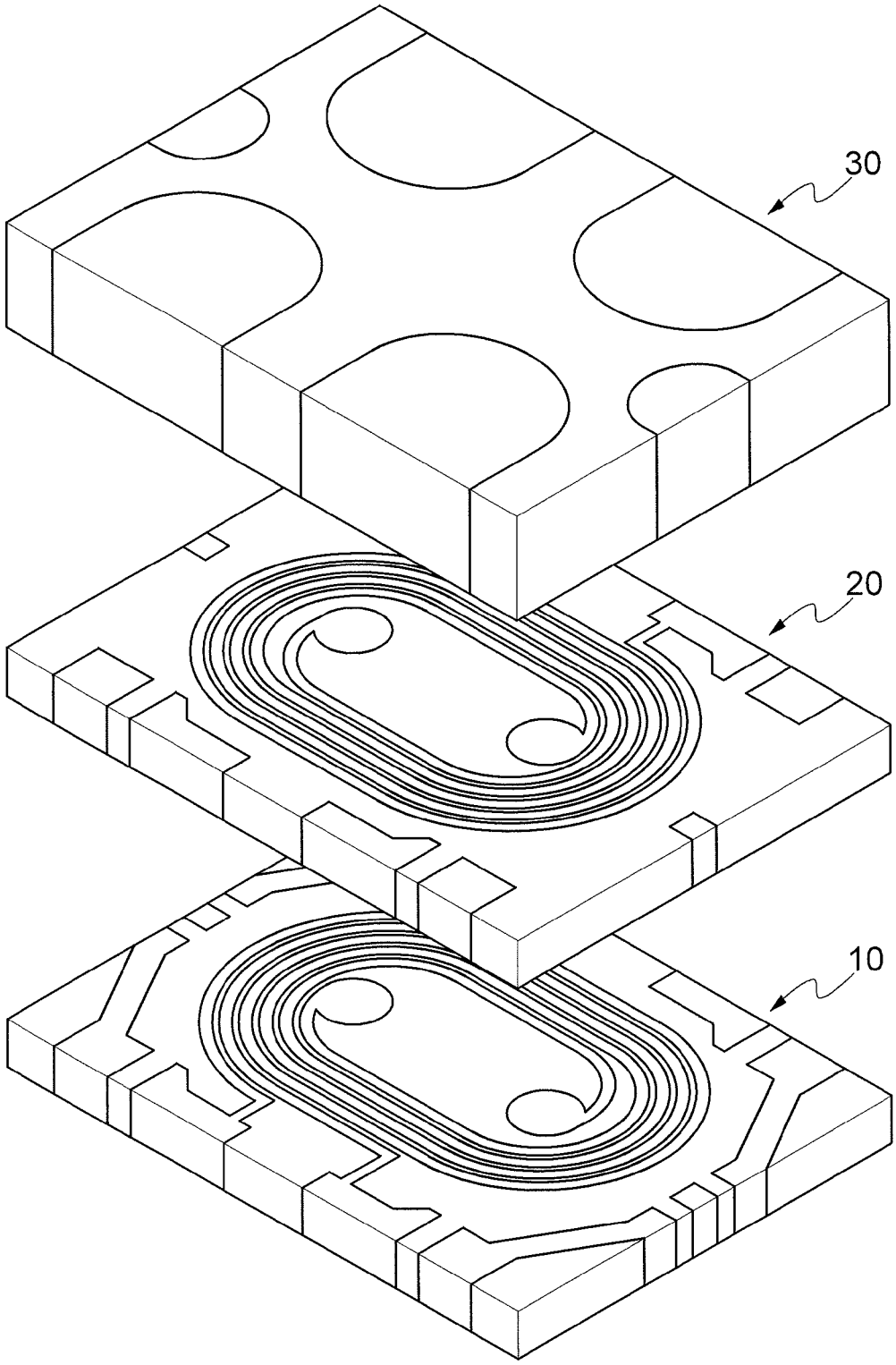
FIG. 2 is an exploded perspective view of FIG. 1.
Figure 3A:
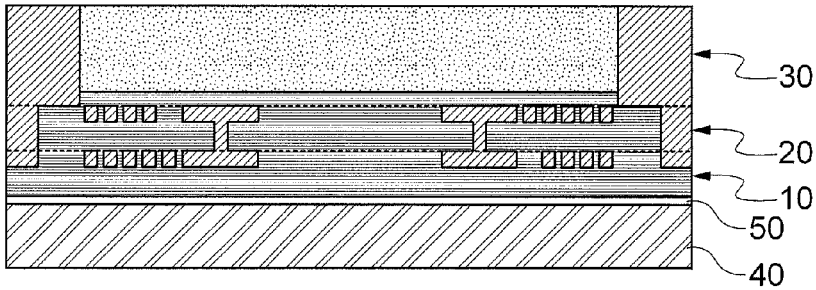
FIG. 3*a* is a cross-sectional view schematically showing a cross section taken along line I-I' of FIG. 1.
Figure 3B:
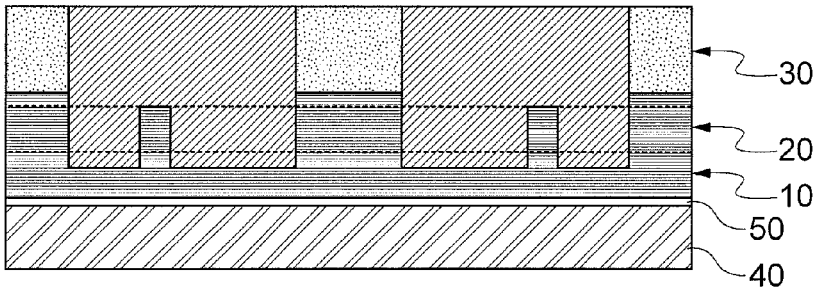
FIG. 3*b* is a cross-sectional view schematically showing a cross section taken along line II-II' of FIG. 1.

FIG. 1 is a perspective view schematically showing an electronic component in accordance with an embodiment of the present invention, FIG. 2 is an exploded perspective view of FIG. 1, FIG. 3*a* is a cross-sectional view schematically showing a cross section taken along line I-I' of FIG. 1, and FIG. 3*b* is a cross-sectional view schematically showing a cross section taken along line II-II' of FIG. 1.

Referring to FIGS. 1 to 3*b*, an electronic component in accordance with an embodiment of the present invention may be formed by additionally providing a discharge terminal in a typical electronic component including a primary coil pattern and a secondary coil pattern with a dielectric 60 or an insulator interposed therebetween.

Further, a discharge electrode may be electrically connected to the discharge terminal and a discharge pattern, which extends from one of four external electrodes electrically connected to both ends of the primary coil pattern or both ends of the secondary coil pattern, may be positioned to be spaced apart from the discharge terminal by a predetermined distance.

At this time, in the present specification, for convenience of description, the distance between the discharge terminal and the discharge pattern will be defined as a gap G.

When the gap G is formed between a conductive material and another conductive material, a size of voltage starting to discharge is changed according to a width of the gap G. For example, in case that the gap G is 1 μm, discharge occurs when a voltage difference between both ends of the gap G is about one hundred thousand volts.

Meanwhile, in various electronic devices, since voltage excessively applied due to static electricity is in the range of about one hundred thousand volts to one million volts, the gap G between the discharge pattern and the discharge terminal in the electronic component in accordance with the present invention may be determined in the range of 1 to 10 μm.

When describing more specifically with reference to FIGS. 1 to 3*b*, the electronic component in accordance with an embodiment of the present invention may include a substrate 40, a first pattern layer 10, a second pattern layer 20, and an external electrode layer 30.

At this time, the substrate 40 may be made of magnetic substances such as ferrite. In this case, the first pattern layer 10 may be formed in a state in which a passive layer 50 is formed on a surface of the substrate 40 to secure insulation between the substrate 40 and a coil pattern.

The first pattern layer 10 may include a first coil pattern portion and a first discharge pattern portion, and the second pattern layer 20 may include a second coil pattern portion and a second discharge pattern portion.

At this time, the first coil pattern portion and the second coil pattern portion may be formed similar to electronic components such as a coil component or a filter component in which coil patterns are formed in plurality of layers.

Further, the first discharge pattern portion may be provided on the same layer as the layer on which the first coil pattern portion is formed, and it is preferred that the first discharge pattern portion is formed in an outer region of the first coil pattern portion to minimize a flow of magnetic flux or the entire area of the electronic component.

The second discharge pattern portion also may be provided on the same layer as the layer on which the second coil pattern portion is formed, and it is preferred that the second discharge pattern portion is formed in an outer region of the second coil pattern portion due to the same reason as that of the first discharge pattern portion.

Meanwhile, in the present specification and drawings, for convenience of description, although the electronic component is divided into the first pattern layer 10, the second pattern layer 20, and the external electrode layer 30 and these layers are dividedly shown in the exploded perspective view, the electronic component in accordance with an embodiment of the present invention should not be construed as limited to a stack type by this expression.

Figure 4:
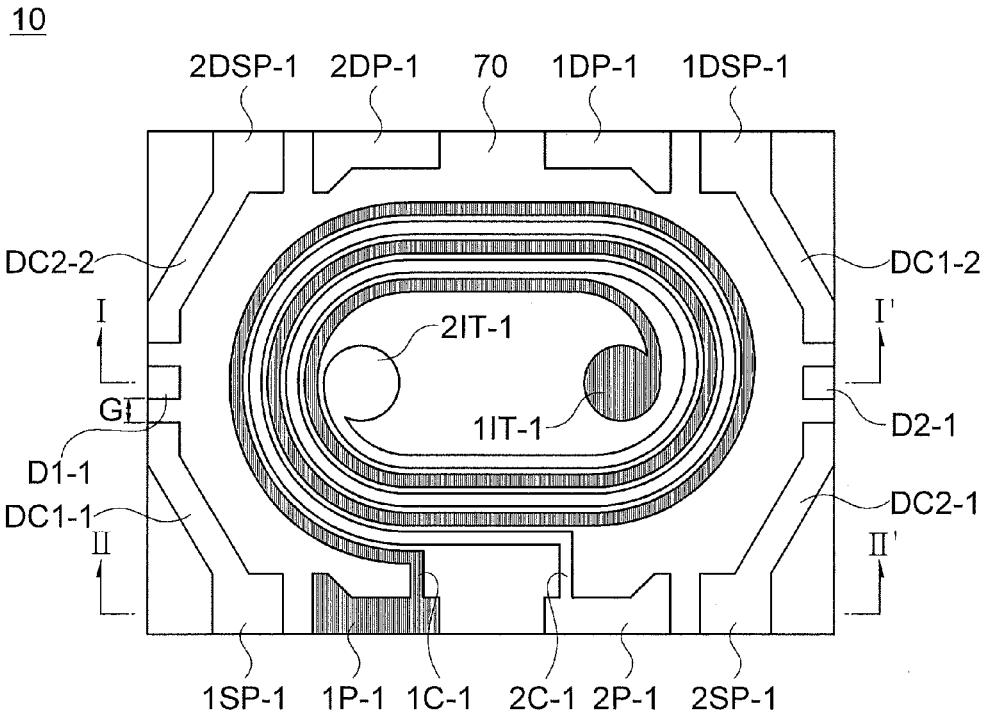
FIG. 4 is a plan view schematically showing a first pattern layer of the electronic component in accordance with an embodiment of the present invention.
Figure 5A:
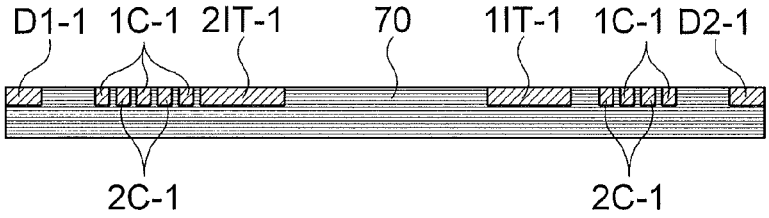
FIG. 5*a* is cross-sectional view schematically showing a cross section taken along line I-I' of FIG. 4.
Figure 5B:
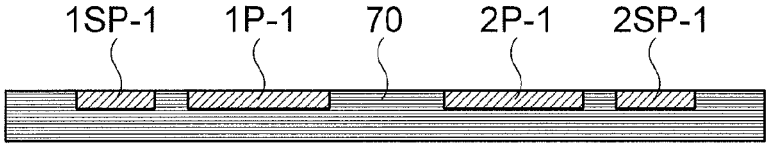
FIG. 5*b* is a cross-sectional view schematically showing a cross section taken along line II-II' of FIG. 4.

FIG. 4 is a plan view schematically showing the first pattern layer 10 of the electronic component in accordance with an embodiment of the present invention, FIG. 5*a* is a cross-sectional view schematically showing a cross section taken along line I-I' of FIG. 4, and FIG. 5*b* is a cross-sectional view schematically showing a cross section taken along line II-II' of FIG. 4.

Referring to FIG. 4, it is possible to understand that the first pattern layer 10 largely includes the first coil pattern portion and the first discharge pattern portion.

First, the first coil pattern portion may include a first primary coil pattern 1C-1, a first secondary coil pattern 2C-1, a first primary pad 1P-1, a first secondary pad 2P-1, a first primary internal terminal 1IT-1, and a first secondary internal terminal 2IT-1.

The first primary coil pattern 1C-1 and the first secondary coil pattern 2C-1 are electrically insulated and magnetically coupled.

The first primary pad 1P-1 is electrically connected to one end of the first primary coil pattern 1C-1, and the first primary internal terminal 1IT-1 is electrically connected to the other end of the first primary coil pattern 1C-1.

The first secondary pad 2P-1 is electrically connected to one end of the first secondary coil pattern 2C-1, and the first secondary internal terminal 2IT-1 is electrically connected to the other end of the first secondary coil pattern 2C-1.

The first primary pad 1P-1 and the first secondary pad 2P-1 may be electrically connected to external electrodes through the following second pattern layer 20, and the first primary internal terminal 1IT-1 and the first secondary internal terminal 2IT-1 may be connected to a second primary internal terminal 1IT-2 and a second secondary internal terminal 2IT-2 of the following second pattern layer 20 through vias 1V and 2V, respectively.

Meanwhile, for convenience of connection with the external electrodes, a first primary dummy pad 1DP-1 and a first secondary dummy pad 2DP-1 may be further disposed on the opposite side to be symmetrical to the first primary pad 1P-1 and the first secondary pad 2P-1.

Next, the first discharge pattern portion may include a first discharge terminal D1-1, a first discharge pattern DC1-1, and a first primary sub pad 1SP-1.

The first primary sub pad 1SP-1 is not in direct contact with the first primary pad 1P-1 while being adjacent to the first primary pad 1P-1.

The first discharge pattern DC1-1 is electrically connected to the first primary sub pad 1SP-1 and formed to extend in the direction of the first discharge terminal D1-1.

The first discharge terminal D1-1 is spaced apart from the first discharge pattern DC1-1 by a predetermined gap G, and the gap G may be determined in the range of 1 to 10 μm.

Meanwhile, a second discharge terminal D2-1, a second discharge pattern DC2-1, and a first secondary sub pad 2SP-1 may be provided instead of the first discharge terminal D1-1, the first discharge pattern DC1-1, and the first primary sub pad 1SP-1.

However, this configuration may be effective when overvoltage or overcurrent applied to the electronic component is introduced into a second primary pad 1P-2 instead of the first primary pad 1P-1.

Further, when the first primary dummy pad 1DP-1 is provided in the first coil pattern portion, a first primary dummy sub pad 1DSP-1, a first dummy discharge pattern DC1-2, and a second discharge electrode ED2 may be provided, and when the first secondary dummy pad 2DP-1 is provided, a first secondary dummy sub pad 2DSP-1, a second dummy discharge pattern DC2-2, and a first discharge electrode ED1 may be provided.

Figure 6:
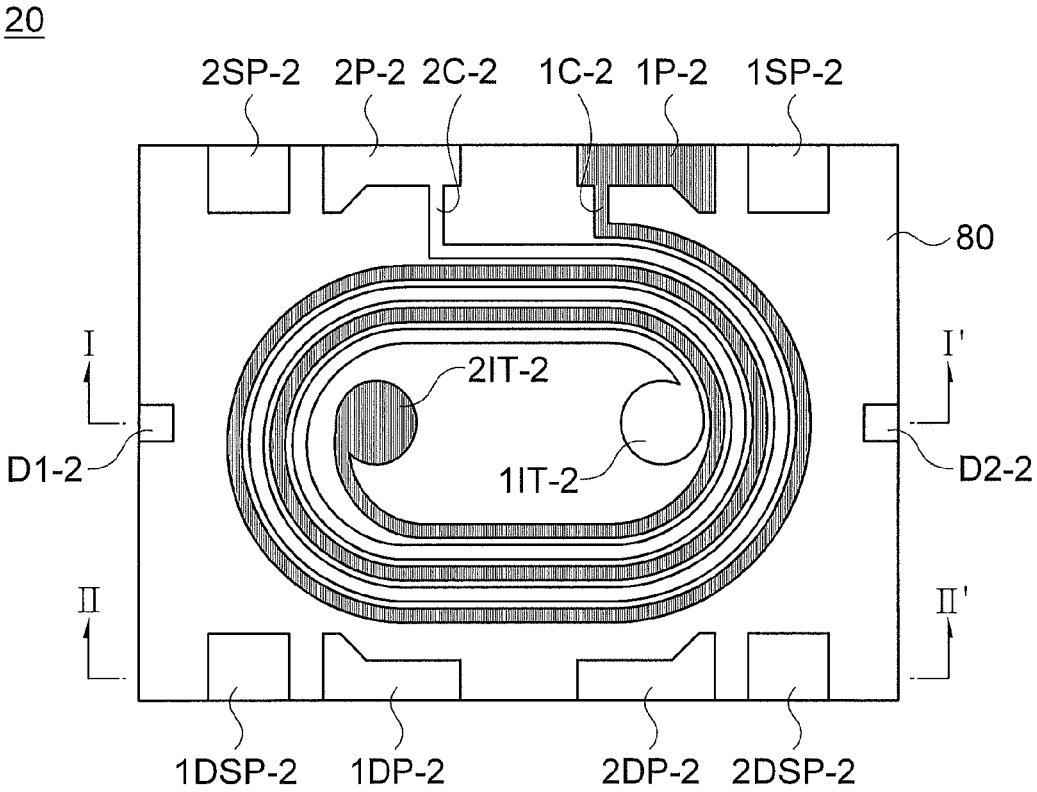
FIG. 6 is a plan view schematically showing a second pattern layer of the electronic component in accordance with an embodiment of the present invention.
Figure 7A:
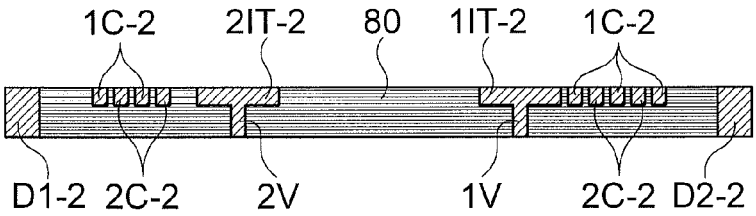
FIG. 7*a* is a cross-sectional view schematically showing a cross section taken along line I-I' of FIG. 6.
Figure 7B:
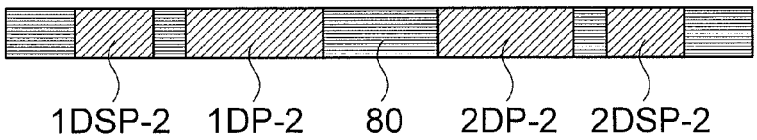
FIG. 7*b* is a cross-sectional view schematically showing a cross section taken along line II-II' of FIG. 6.

FIG. 6 is a plan view schematically showing the second pattern layer 20 of the electronic component in accordance with an embodiment of the present invention, FIG. 7*a* is a cross-sectional view schematically showing a cross section taken along line I-I' of FIG. 6, and FIG. 7*b* is a cross-sectional view schematically showing a cross section taken along line II-II' of FIG. 6.

Referring to FIGS. 6 and 7*b*, the second pattern layer 20 may largely include a second coil pattern portion and a second discharge pattern portion, and it is possible to understand that the second pattern layer 20 is similar to the shape formed by turning over the above-described first pattern layer 10 shown in FIG. 5.

First, the second coil pattern portion may include a second primary coil pattern 1C-2, a second secondary coil pattern 2C-2, a second primary pad 1P-2, a second secondary pad 2P-2, a second primary internal terminal 1IT-2, and a second secondary internal terminal 2IT-2.

The second primary coil pattern 1C-2 and the second secondary coil pattern 2C-2 are electrically insulated and magnetically coupled.

The second primary pad 1P-2 is electrically connected to one end of the second primary coil pattern 1C-2, and the second primary internal terminal 1IT-2 is electrically connected to the other end of the second primary coil pattern 1C-2.

The second secondary pad 2P-2 is electrically connected to one end of the second secondary coil pattern 2C-2, and the second secondary internal terminal 2IT-2 is electrically connected to the other end of the second secondary coil pattern 2C-2.

The second primary pad 1P-2 and the second secondary pad 2P-2 may be electrically connected to the external electrodes of the following external electrode layer 30, and the second primary internal terminal 1IT-2 and the second secondary internal terminal 2IT-2 may be connected to the first primary internal terminal 1IT-1 and the first secondary internal terminal 2IT-1 of the above-described first pattern layer 10 through the vias IV and 2V, respectively.

Meanwhile, for convenience of connection with the external electrodes, a second primary dummy pad 1DP-2 and a second secondary dummy pad 2DP-2 may be further provided on the opposite side to be symmetrical to the second primary pad 1P-2 and the second secondary pad 2P-2.

Next, the second discharge pattern portion may include a first additional discharge terminal D1-2 and a second primary dummy sub pad 1DSP-2.

The second primary dummy sub pad 1DSP-2 is not in direct contact with the second primary dummy pad 1DP-2 while being adjacent to the second primary dummy pad 1DP-2.

The first additional discharge terminal D1-2 is electrically connected to the first discharge terminal D1-1.

Meanwhile, a second additional discharge terminal D2-2 may be provided instead of the first additional discharge terminal D1-2 according to a modified example of the above-described first pattern layer 10.

Further, instead of providing the first dummy discharge pattern DC1-2 on the first pattern layer 10, a component similar to the first dummy discharge pattern DC1-2 may be provided on the second pattern layer 20.

That is, although not shown, it is possible to further provide a dummy discharge pattern which is formed to extend in the direction from the second primary sub pad 1SP-2 adjacent to the second primary pad 1P-2 to the second additional discharge terminal D2-2 and to secure the gap G between the dummy discharge pattern and the second additional discharge terminal D2-2.

Figure 8:
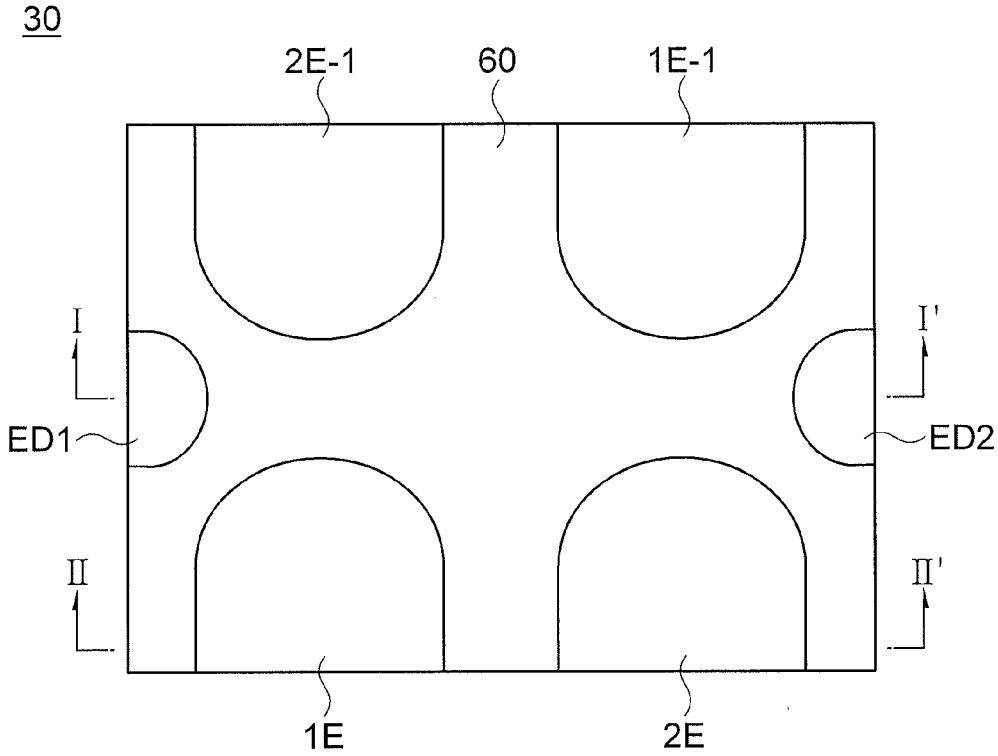
FIG. 8 is a plan view schematically showing an external electrode layer of the electronic component in accordance with an embodiment of the present invention.
Figure 9A:
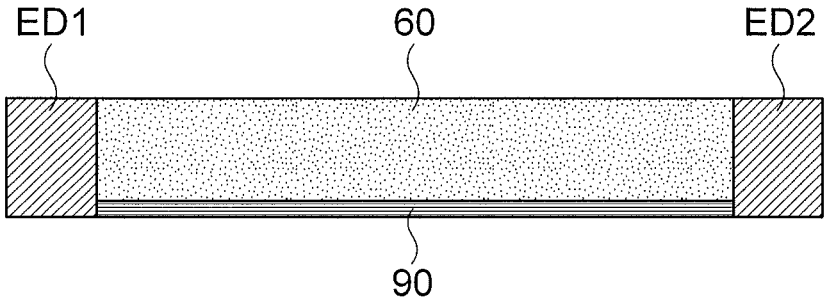
FIG. 9*a* is a cross-sectional view schematically showing a cross section taken along line I-I' of FIG. 8.
Figure 9B:
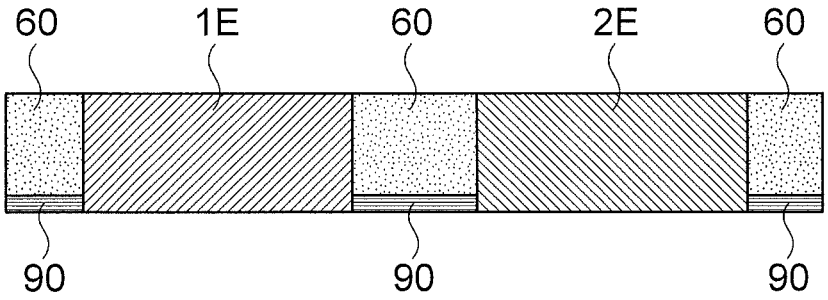
FIG. 9*b* is a cross-sectional view schematically showing a cross section taken along line II-II' of FIG. 8.

FIG. 8 is a plan view schematically showing the external electrode layer 30 of the electronic component in accordance with an embodiment of the present invention, FIG. 9*a* is a cross-sectional view schematically showing a cross section taken along line I-I' of FIG. 8, and FIG. 9*b* is a cross-sectional view schematically showing a cross section taken along line II-II' of FIG. 8.

Referring to FIGS. 8 to 9*b*, the external electrode layer 30 may be divided largely into a coil electrode portion and a discharge electrode portion.

First, the coil electrode portion may include a first primary external electrode 1E, a second primary external electrode 2E-2, a first secondary external electrode 2E, and a second secondary external electrode 2E-1, and the discharge electrode portion may include the first discharge electrode ED1.

Further, the second discharge electrode ED2 may be further provided in the discharge electrode portion.

The first primary external electrode 1E may be electrically connected to the second primary dummy pad 1DP-2 and the second primary dummy sub pad 1DSP-2. Therefore, the first primary pad 1P-1 electrically connected to the second primary dummy pad 1DP-2 and one end of the first primary coil pattern 1C-1 electrically connected to the first primary pad 1P-1 are connected to the first primary external electrode 1E. Further, the first discharge pattern DC1-1 is also electrically connected to the first primary external electrode 1E through the first primary sub pad 1SP-1 electrically connected to the second primary dummy sub pad 1DSP-2.

The second primary external electrode 2E-2 may be electrically connected to the second primary pad 1P-2 and the second primary sub pad 1SP-2. Therefore, one end of the second primary coil pattern 1C-2 electrically connected to the second primary pad may be connected to the second primary external electrode 2E-2. Further, the first dummy discharge pattern DC1-2 also may be electrically connected to the second primary external electrode 2E-2 through the first primary dummy sub pad 1DSP-1 electrically connected to the second primary sub pad 1SP-2.

The first secondary external electrode 2E may be electrically connected to the second secondary dummy pad 2DP-2 and the second secondary dummy sub pad 2DSP-2. Therefore, the first secondary pad 2P-1 electrically connected to the second secondary dummy pad 2DP-2 and one end of the first secondary coil pattern 2C-1 electrically connected to the first secondary pad 2P-1 are connected to the first secondary external electrode 2E. Further, the second discharge pattern DC2-1 also may be electrically connected to the first secondary external electrode 2E through the first secondary sub pad 2SP-1 electrically connected to the second secondary dummy sub pad 2DSP-2.

The second secondary external electrode 2E-1 may be electrically connected to the second secondary pad 2P-2 and the second secondary sub pad 2SP-2. Therefore, one end of the second secondary coil pattern 2C-2 electrically connected to the second secondary pad 2P-2 may be connected to the second secondary external electrode 2E-1. Further, the second dummy discharge pattern DC2-2 also may be electrically connected to the second secondary external electrode 2E-1 through the first secondary dummy sub pad 2DSP-1 electrically connected to the second secondary sub pad 2SP-2.

Meanwhile, the first discharge electrode ED1 may be electrically connected to the first discharge terminal D1-1 through the first additional discharge terminal D1-2, and the second discharge electrode ED2 may be electrically connected to the second discharge terminal D2-1 through the second additional discharge terminal D2-2.

Accordingly, when a normal signal is applied to the first primary external electrode 1E, it flows to the first primary coil pattern 1C-1 and the electronic component operates normally, but when an abnormal signal is applied to the first primary external electrode 1E, since overvoltage or overcurrent is induced to the first primary sub pad 1SP-1 and the first discharge pattern DC1-1 to be discharged to the first discharge terminal D1-1, it is possible to prevent deterioration of other components of the electronic component including the first primary coil pattern 1C-1.

Further, as described in the above-described various embodiments, according to a position of the terminal to which an external signal is applied or through which static electricity is introduced inside the electronic component, the first discharge pattern portion, the second discharge pattern portion, and the discharge electrode portion may be applied after being modified appropriately according to needs.

Figure 10:
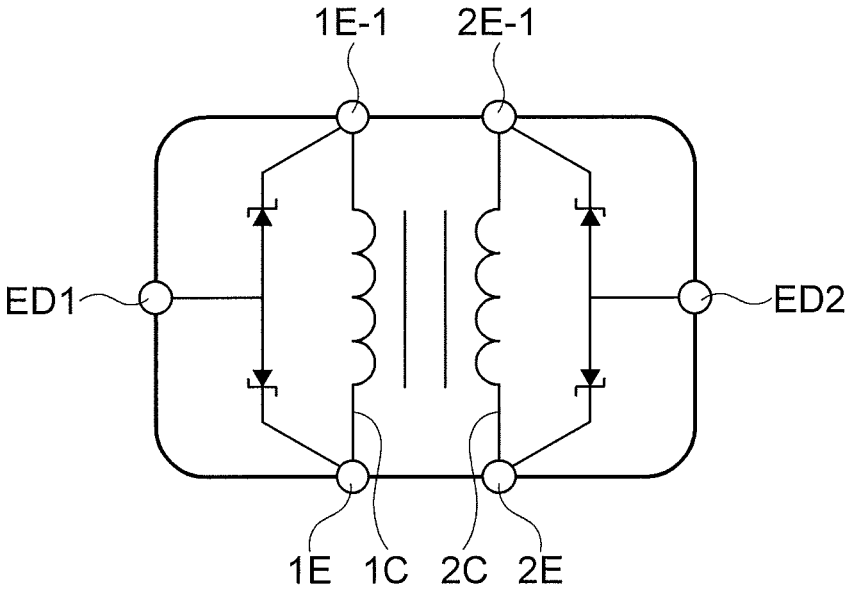
FIG. 10 is a circuit diagram of the electronic component in accordance with an embodiment of the present invention.

FIG. 10 is a circuit diagram of the electronic component in accordance with an embodiment of the present invention.

Referring to FIG. 10, when overvoltage or overcurrent is applied to the first primary external electrode 1E, the overvoltage or the overcurrent can be discharged through the first discharge electrode ED1. When a normal signal is applied to the first primary external electrode 1E, since insulation between the first discharge electrode ED1 and the first primary external electrode 1E is secured by the gap G, the signal flows through a normal path so that the electronic component can operate.

Since the second primary external electrode 2E-2, the first secondary external electrode 2E, and the second secondary external electrode 2E-1 are the same as the above description, repeated description will be omitted.

Figure 11:
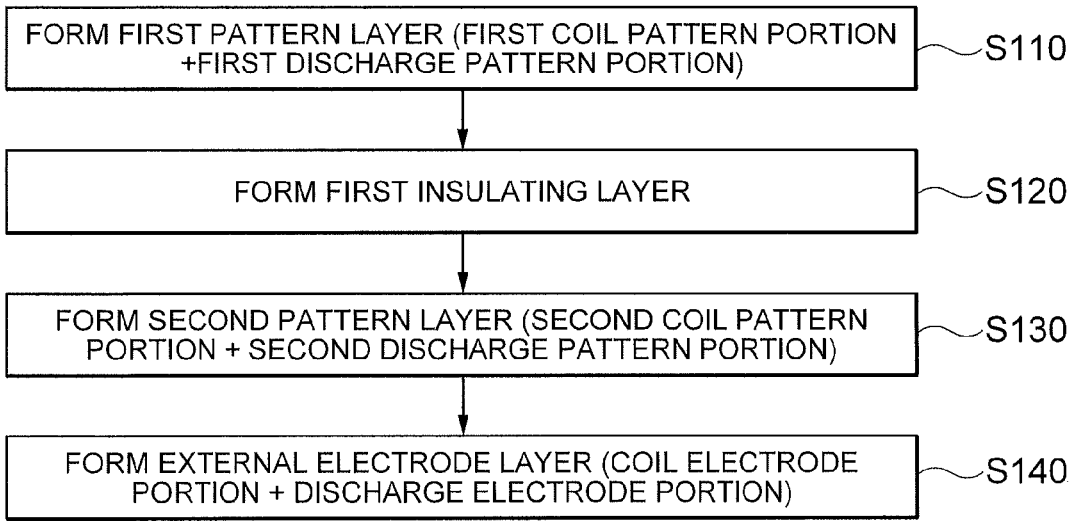
FIG. 11 is a flowchart schematically showing a method for manufacturing an electronic component in accordance with an embodiment of the present invention.

FIG. 11 is a flowchart schematically showing a method for manufacturing an electronic component in accordance with an embodiment of the present invention.

Referring to FIGS. 1 to 11, a method for manufacturing an electronic component in accordance with an embodiment of the present invention may include the steps of forming a first pattern layer 10 by using a first photoresist pattern which exposes regions where a first coil pattern portion and a first discharge pattern portion are to be formed (S110), forming a first insulating layer by applying an insulator or a dielectric 60 on a top surface of the first pattern layer 10 (S120), forming a second pattern layer 20 on a top surface of the first insulating layer by using a second photoresist pattern which exposes regions where a second coil pattern portion and a second discharge pattern portion are to be formed (S130), and forming an external electrode layer 30 on a top surface of the second pattern layer 20 by using a third photoresist pattern which exposes regions where a coil electrode portion and a discharge electrode portion are to be formed (S140).

Accordingly, it is not required to add separate processes for forming the first discharge pattern portion, the second discharge pattern portion, the discharge electrode portion, and so on, and a discharge means can be provided on the same layer as the layer on which the first coil pattern portion, the second coil pattern portion, and the coil electrode portion are formed, respectively.

Further, it is preferred that the above-described gap G is determined in the range of 1 to 10 μm. When applying methods such as a method of forming a conductive pattern by printing, it is difficult to form the gap G of less than 10 μm and uniformity of the gap G also cannot be secured.

On the contrary, in the present invention, since the discharge means including the gap G is formed by using a photoresist method, it is possible to precisely and uniformly form the gap G in the required range.

Since the electronic component in accordance with an embodiment of the present invention configured as above can efficiently discharge overvoltage or overcurrent applied to the electronic component, it is possible to improve reliability of various electronic devices to which the electronic component in accordance with an embodiment of the present invention is applied as well as to extend lifespan of the electronic component itself.

Further, since a structure which can discharge static electricity without increases in area or thickness of the electronic component can be mounted inside the electronic component, it is advantageous to miniaturization.

The foregoing description illustrates the present invention. Additionally, the foregoing description shows and explains only the preferred embodiments of the present invention, but it is to be understood that the present invention is capable of use in various other combinations, modifications, and environments and is capable of changes and modifications within the scope of the inventive concept as expressed herein, commensurate with the above teachings and/or the skill or knowledge of the related art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. An electronic component comprising a first pattern layer, a second pattern layer, and an external electrode layer, the first pattern layer comprising a first coil pattern portion comprising a first primary coil pattern, a first secondary coil pattern, a first primary pad electrically connected to one end of the first primary coil pattern, a first secondary pad electrically connected to one end of the first secondary coil pattern, a first primary internal terminal electrically connected to another end of the first primary coil pattern, and a first secondary internal terminal electrically connected to another end of the first secondary coil pattern, and a first discharge pattern portion comprising a first primary sub pad disposed adjacent to the first primary pad, a first discharge pattern of which one end is electrically connected to the first primary sub pad, and a first discharge terminal disposed to be spaced apart from the first discharge pattern by a predetermined gap;

the second pattern layer comprising a second coil pattern portion comprising a second primary coil pattern, a second secondary coil pattern, a second primary pad electrically connected to one end of the second primary coil pattern, a second secondary pad electrically connected to one end of the second secondary coil pattern, a second primary internal terminal electrically connected to another end of the second primary coil pattern, a second secondary internal terminal electrically connected to another end of the second secondary coil pattern, and a second primary dummy pad electrically connected to the first primary pad, and a second discharge pattern portion comprising a first additional discharge terminal electrically connected to the first discharge terminal and a second primary dummy sub pad adjacent to the second primary dummy pad and electrically connected to the first primary sub pad;

the external electrode layer comprising a coil electrode portion comprising a first primary external electrode electrically connected to one end of a primary coil pattern formed by connecting the first primary coil pattern and the second primary coil pattern, a second primary external electrode electrically connected to another end of the primary coil pattern, a first secondary external electrode electrically connected to one end of a secondary coil pattern formed by connecting the first secondary coil pattern and the second secondary coil pattern, and a second secondary external electrode electrically connected to another end of the secondary coil pattern; and a discharge electrode portion comprising a first discharge electrode electrically connected to the first additional discharge terminal, the second primary dummy sub pad is electrically connected to the first primary external electrode.

2. The electronic component according to claim 1, wherein the first coil pattern portion further comprises a first primary dummy pad electrically connected to the second primary pad, wherein the first discharge pattern portion further comprises a first primary dummy sub pad adjacent to the first primary dummy pad and electrically connected to the second primary external electrode, a first dummy discharge pattern electrically connected to the first primary dummy sub pad, and a second discharge terminal disposed to be spaced apart from the first dummy discharge pattern by a predetermined gap, wherein the second discharge pattern portion further comprises a second primary pad electrically connected to one end of the second primary coil pattern, a second primary sub pad adjacent to the second primary pad and electrically connected to the first primary dummy sub pad, and a second additional discharge terminal electrically connected to the second discharge terminal, and wherein the second primary sub pad is electrically connected to the second primary external electrode and the external electrode layer further comprises a second discharge electrode electrically connected to the second additional discharge terminal.

3. The electronic component according to claim 1, wherein the first coil pattern portion further comprises a first primary dummy pad electrically connected to the second primary pad, wherein the first discharge pattern portion further comprises a first primary dummy sub pad adjacent to the first primary dummy pad and electrically connected to the second primary external electrode, and a second discharge terminal, wherein the second discharge pattern portion further comprises a second primary pad electrically connected to one end of the second primary coil pattern, a second primary sub pad adjacent to the second primary sub pad and electrically connected to the first primary dummy sub pad, a first dummy discharge pattern electrically connected to the second primary sub pad, and a second additional discharge terminal spaced apart from the first dummy discharge pattern by a predetermined gap and electrically connected to the second discharge terminal, and wherein the second primary sub pad is electrically connected to the second primary external electrode and the external electrode layer further comprises a second discharge electrode electrically connected to the second additional discharge terminal.

4. An electronic component comprising a first pattern layer, a second pattern layer, and an external electrode layer, the first pattern layer comprising a first coil pattern portion comprising a first primary coil pattern, a first secondary coil pattern, a first primary pad electrically connected to one end of the first primary coil pattern, a first secondary pad electrically connected to one end of the first secondary coil pattern, a first primary internal terminal electrically connected to another end of the first primary coil pattern, and a first secondary internal terminal electrically connected to another end of the first secondary coil pattern, and a first discharge pattern portion comprising a first secondary sub pad disposed adjacent to the first secondary pad, a second discharge pattern of which one end is electrically connected to the first secondary sub pad, and a second discharge terminal disposed to be spaced apart from the second discharge pattern by a predetermined gap;

the second pattern layer comprising a second coil pattern portion comprising a second primary coil pattern, a second secondary coil pattern, a second primary pad electrically connected to one end of the second primary coil pattern, a second secondary pad electrically connected to one end of the second secondary coil pattern, a second primary internal terminal electrically connected to another end of the second primary coil pattern, a second secondary internal terminal electrically connected to another end of the second secondary coil pattern, and a second secondary dummy pad electrically connected to the first secondary pad, and a second discharge pattern portion comprising a second additional discharge terminal electrically connected to the second discharge terminal and a second secondary dummy sub pad adjacent to the second secondary dummy pad and electrically connected to the first secondary sub pad;

the external electrode layer comprising a coil electrode portion comprising a first primary external electrode electrically connected to one end of a primary coil pattern formed by connecting the first primary coil pattern and the second primary coil pattern, a second primary external electrode electrically connected to another end of the primary coil pattern, a first secondary external electrode electrically connected to one end of a secondary coil pattern formed by connecting the first secondary coil pattern and the second secondary coil pattern, and a second secondary external electrode electrically connected to another end of the secondary coil pattern; and a discharge electrode portion comprising a second discharge electrode electrically connected to the second additional discharge terminal, the second secondary dummy sub pad is electrically connected to the first secondary external electrode.

5. The electronic component according to claim 4, wherein the first coil pattern portion further comprises a first secondary dummy pad electrically connected to the second secondary pad, wherein the first discharge pattern portion further comprises a first secondary dummy sub pad adjacent to the first secondary dummy pad and electrically connected to the second secondary external electrode, a second dummy discharge pattern electrically connected to the first secondary dummy sub pad, and a first discharge terminal disposed to be spaced apart from the second dummy discharge pattern by a predetermined gap, wherein the second discharge pattern portion further comprises a second secondary pad electrically connected to one end of the second secondary coil pattern, a second secondary sub pad adjacent to the second secondary pad and electrically connected to the first secondary dummy sub pad, and a first additional discharge terminal electrically connected to the first discharge terminal, and wherein the second secondary sub pad is electrically connected to the second secondary external electrode and the external electrode layer further comprises a first discharge electrode electrically connected to the first additional discharge terminal.

6. The electronic component according to claim 4, wherein the first coil pattern portion further comprises a first secondary dummy pad electrically connected to the second secondary pad, wherein the first discharge pattern portion further comprises a first secondary dummy sub pad adjacent to the first secondary dummy pad and electrically connected to the second secondary external electrode, and a first discharge terminal, wherein the second discharge pattern portion further comprises a second secondary pad electrically connected to one end of the second secondary coil pattern, a second secondary sub pad adjacent to the second secondary pad and electrically connected to the first secondary dummy sub pad, a second dummy discharge pattern electrically connected to the second secondary sub pad, and a first additional discharge terminal spaced apart from the second dummy discharge pattern by a predetermined gap and electrically connected to the first discharge terminal, and wherein the second secondary sub pad is electrically connected to the second secondary external electrode and the external electrode layer further comprises a first discharge electrode electrically connected to the first additional discharge terminal.

7. The electronic component according to claim 4, wherein the gap is determined in the range of 1 to 10 μm.

* * * * *